US005095294A

United States Patent [19]

Chikira et al.

[11] Patent Number: 5,095,294

[45] Date of Patent: Mar. 10, 1992

[54] ELECTROMAGNETIC RELAY

[75] Inventors: Toru Chikira; Yasuyuki Shinbori; Mitsutoshi Kawai, all of Yokohama, Japan

[73] Assignee: Jidosha Denki Kogyo K.K., Kanagawa, Japan

[21] Appl. No.: 611,229

[22] Filed: Nov. 8, 1990

[30] Foreign Application Priority Data

Nov. 30, 1989 [JP] Japan ..... 1-138780

[51] Int. Cl.[5] ..... H01H 51/22

[52] U.S. Cl. ..... 335/78; 335/128

[58] Field of Search ..... 335/78-86, 335/124, 128, 251

[56] References Cited

U.S. PATENT DOCUMENTS 3,133,172 5/1964 Williams et al. ..... 335/78
3,308,407 3/1967 Laue et al. ..... 335/80
3,355,629 11/1967 Schapira ..... 335/81
3,848,205 11/1974 Schantz et al. ..... 335/128
4,254,391 3/1981 Gould ..... 335/121
4,604,598 8/1986 Naser et al. ..... 335/128
4,881,053 11/1989 Tanaka et al. ..... 335/80
4,972,166 11/1990 Mitsch et al. ..... 335/128

*Primary Examiner*—Leo P. Picard
*Assistant Examiner*—Lincoln Donovan
*Attorney, Agent, or Firm*—Sughrue, Mion, Zinn, Macpeak & Seas

[57] ABSTRACT

An electromagnetic relay is provided with resilient pieces which are formed in one body with movable contacts, spring parts and the contacting parts and fulfils the function instead of movable contact pieces, a coil spring and the woven wires connecting between the movable contacts and the terminals. According to the invention, it is possible to reduce the cost and the dispersion in the performance of the relay.

2 Claims, 6 Drawing Sheets

ELECTROMAGNETIC RELAY

BACKGROUND OF THE INVENTION

1. Field of the Invention

This invention relates to an electromagnetic relay used for opening and closing a circuit by operating an armature according to an excitation of a coil.

2. Description of The Prior Art

Heretofore, there has been used an electromagnetic relay as shown, for example, in FIG. 6 and FIG. 7.

In an electromagnetic relay 100 shown in the figures, a base 101 is fixed with a frame 102 for forming a magnetic circuit, the frame 102 is fixed with an iron core 103*a* of a coil 103, and fixed contact terminals 106 and 107 provided with respective fixed contacts 104 and 105 are fixed in the base 101 by insert molding.

A conductive hinge 108 having stiffness is engaged to a projection 102*b* provided on an upper face 102*a* of the frame 102 in FIG. 6 at one end thereof and is attached to an armature 109 at another end thereof, the armature 109 is so designed as to rotate around the projection 102*b* provided on the frame 102 within a range restricted by contacting a restraint part 108*a* of the hinge 108 with the frame 102.

A coil spring 110 is engaged between a hook 109*a* provided to the upper end of the armature 109 and a hook 102*d* provided to the upper end of a side wall 102*c* of the frame 102 on the right side in FIG. 6.

And, two movable pieces 113 and 114 which are disposed with movable contacts 111 and 112 respectively at lower ends thereof in FIG. 6 are fixed to the armature 109 through a block 109*a* made of non-conducting material so as to be insulated from the armature 109 and to be united with the armature 109.

The movable contact pieces 113 and 114 are connected to ends of woven wires 115 and 116 at upper ends thereof by spot welding respectively as shown in FIG. 6, and the other ends of the respective woven wires 115 and 116 are connected similarly by spot welding to respective movable contact terminals 117 and 118 which are fixed opposite to the fixed contacts 104 and 105 in the base 101 by insert molding.

Furthermore, either end of a wound wire 103*b* of the coil 103 is connected to respective coil terminals 119 and 120 fixed similarly in the base 101.

The electromagnetic relay 100 is so structured as to be assembled into the state in which the armature 109 is detached from the iron core 103*a* by fixing the frame 102 to the base 101 with a screw (not shown) while contacting the respective movable contact pieces 113 and 114 with the respective movable contact terminals 117 and 118 at the state in which the armature 109 is connected to the frame 102 by the hinge 108 and the coil spring 110.

At the unexcited state of the coil 103 shown in FIG. 6, the armature 109 is energized in the clockwise direction around the one end of the hinge 108 by tensile force of the coil spring 110, and the respective movable contact pieces 113 and 114 are in contact with the respective movable contact terminals 117 and 118.

In this state, supplying a predetermined electric current to the coil 103 through the coil terminals 119 and 120 by changing a switch (not shown), magnetic flux passing from the iron core 103*a* to the armature 109 through the frame 102 and the hinge 108 is generated by the excitation of the coil 103, and the armature 109 is attracted toward the iron core 103*a*, that is in the anticlockwise direction in FIG. 6.

Thereby, the respective movable contact pieces 113 and 114 separate from the movable contact terminals 117 and 118 and the movable contacts 111 and 112 disposed on the movable contact pieces 113 and 114 come in contact with the respective fixed contacts 104 and 105, so that the movable contact terminals 117 and 118 are connected electrically with the fixed contact terminals 106 and 107, respectively.

And in this state, cutting the power supply through the coil terminals 119 and 120 by changing the switch, the coil 103 becomes unexcited state and the armature 109 returns in the clockwise direction in FIG. 6 by the tensile force of the coil spring 110, so that the respective movable contacts 111 and 112 separate from the respective fixed contacts 104 and 105, and the movable contact pieces 113 and 114 come in contact with the movable contact terminals 117 and 118. Thereby, the electromagnetic relay 100 returns to the state as shown in FIG. 6.

However, aforementioned conventional electromagnetic relay 100 is so structured as to energize the armature 109 through the hinge 108 in the direction away from the iron core 103*a* by the coil spring 110 engaged between the armature 109 and the frame 102, and the respective movable contact pieces 113 and 114 are connected with the respective movable contact terminals 117 and 118 through the woven wires 115 and 116. Accordingly, there is a problem in that it is unfavorable in the cost since the number of parts is too numerous.

Furthermore, it is not possible to keep the distance between the armature 109 and the iron core 103*a* constant owing to dimensional errors of the respective parts such as the movable contact pieces 113 and 114, the coil spring 110, the hinge 108 and the frame 102. There is another problem since some differences in the performance of the relay may arise among products.

SUMMARY OF THE INVENTION

The present invention is made in view of the aforementioned problems of the conventional electromagnetic relay, it is an object to provide an electromagnetic relay which is possible to reduce the cost and has a regular performance without the dispersion.

The construction of the electromagnetic relay according to this invention for attaining the aforementioned object is characterized in that it comprises a frame for forming a magnetic circuit, a coil having an iron core fixed to the frame, an armature to be attracted by the iron core in accordance with an excitation of the coil, at least two of resilient pieces attached with the armature and fixed to the frame, movable contacts fixed to the respective resilient pieces, movable contact terminals to be connected with the respective movable contacts, fixed contacts to be in contact or out of contact with the respective movable contacts in response to an attraction of the armature caused by the excitation of the coil, fixed contact terminals provided with the respective fixed contacts, and each of the resilient pieces is fixed to the frame through an insulating member and provided with the movable contact at one end, a contacting part to be connected with the movable contact terminal at another end, and a spring part for energizing the armature in the direction away from the iron core in an unexcited state of the coil at a middle portion thereof as united one body. And an electromagnetic relay according to another aspect of this invention is characterized in that the frame is provided with a serration on an upper frame plate thereof for making a distance between the armature and the iron core of the coil uniform by controlling mounting position of the insulating member fixed with the resilient pieces.

The electromagnetic relay according to this invention is provided with the resilient pieces to the frame through the insulating member, the resilient piece is provided in the united one body with the movable contact at one end, the contacting part to be contact with the movable contact terminal at another end, and the spring part for energizing the armature in the direction away from the iron core at a middle portion thereof. And the resilient piece fulfils the function entirely instead of the movable contact piece, the coil spring and the woven wire, accordingly the number of parts decreases and the production cost reduces. Furthermore, irregularity in the performance reduces since it is possible to solve the errors in measurement caused by assembling the parts.

DESCRIPTION OF THE PREFERRED EMBODIMENT

An embodiment of the electromagnetic relay according to this invention will be described below on basis of FIG. 1 to FIG. 5.

Figure 1:
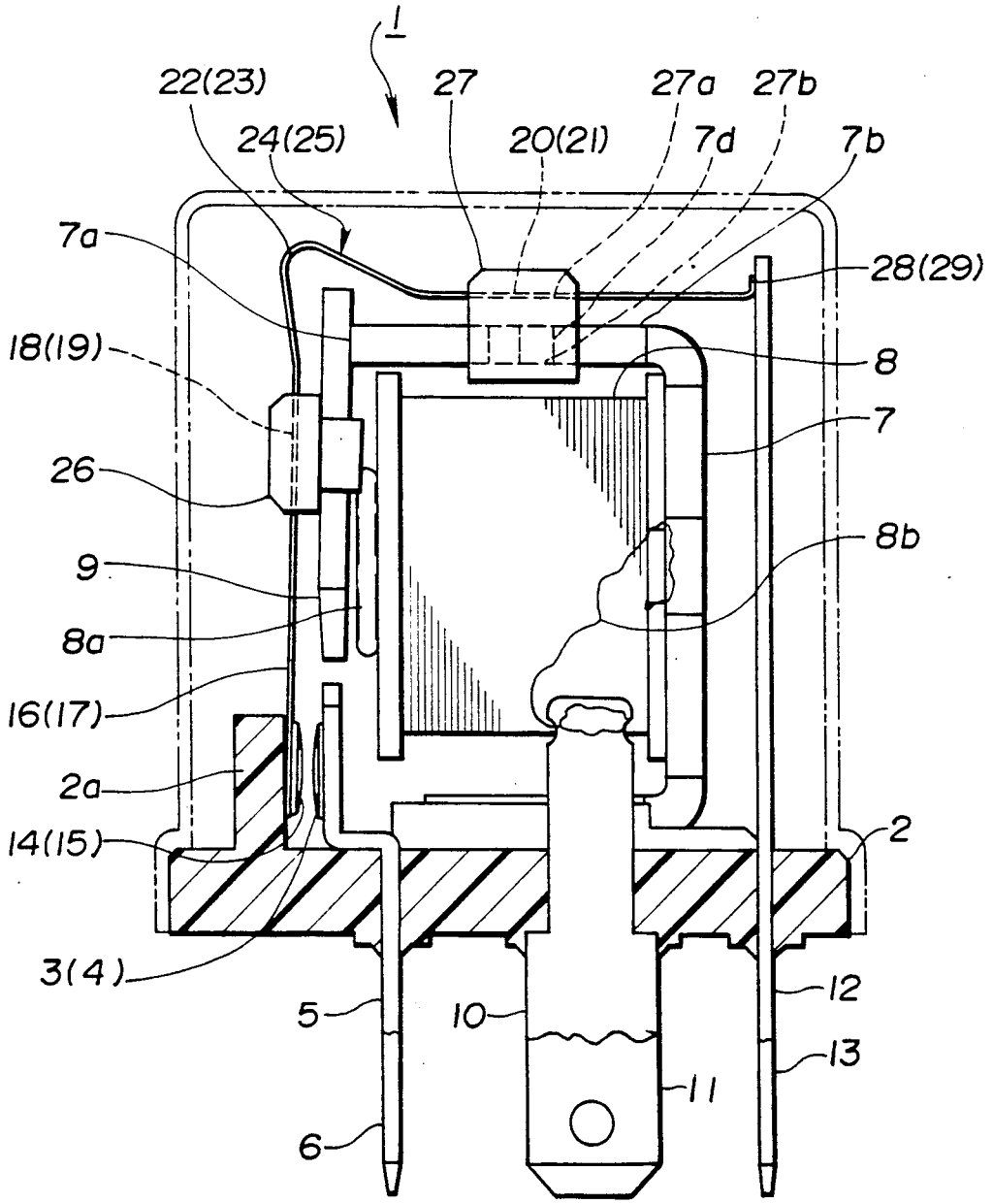
FIG. 1 is a partially sectional side view illustrating the electromagnetic relay according to an embodiment of this invention.

An electromagnetic relay 1 shown in figures is fixed with fixed contact terminals 5 and 6 provided with fixed contacts 3 and 4 in a base 2 made of non-conducting material at the position moved toward the left side in FIG. 1 respectively, and a frame 7 for forming a magnetic circuit is fixed on the base 2 at the middle portion thereof by driving a screw (not shown) into the frame 7 passing through the base 2.

The frame 7 is secured with an iron core 8*a* of a coil 8 and disposed with an armature 9 to be attached toward the iron core 8*a* by excitation of the coil 8 on the left side in FIG. 1 at the state in contact with a left side end 7*a* of the frame 7 by resilient pieces 24 and 25 (which will be described later).

Figure 2:
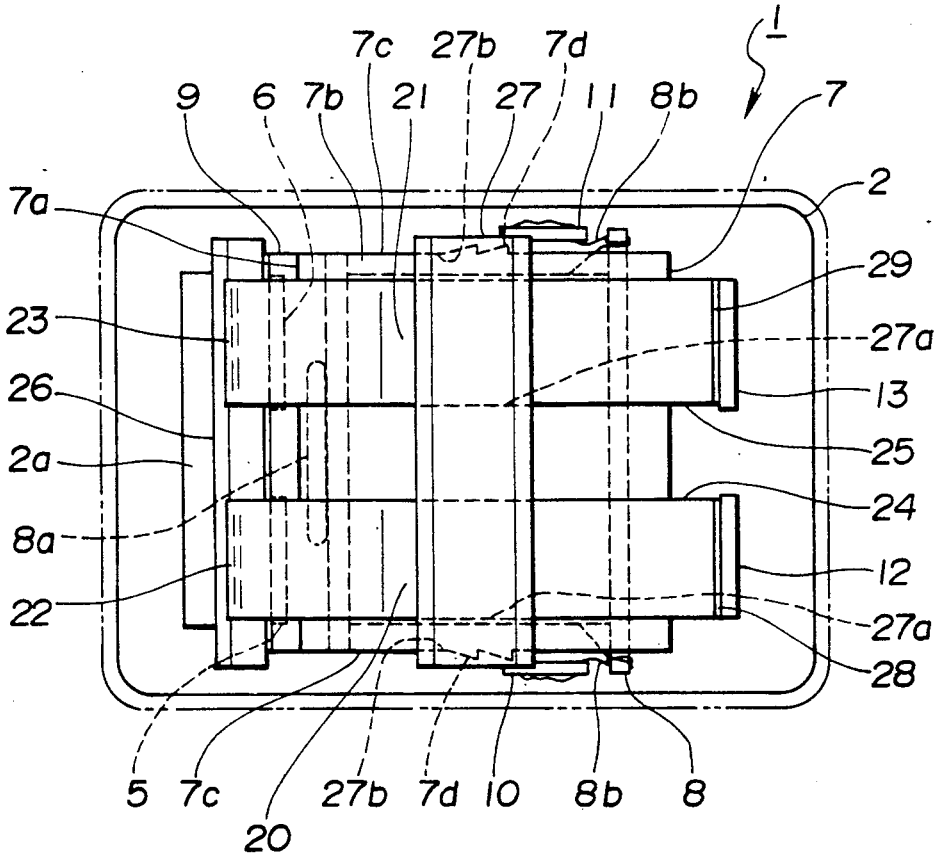
FIG. 2 is a top plan view of the electromagnetic relay shown in FIG. 1.
Figure 3:
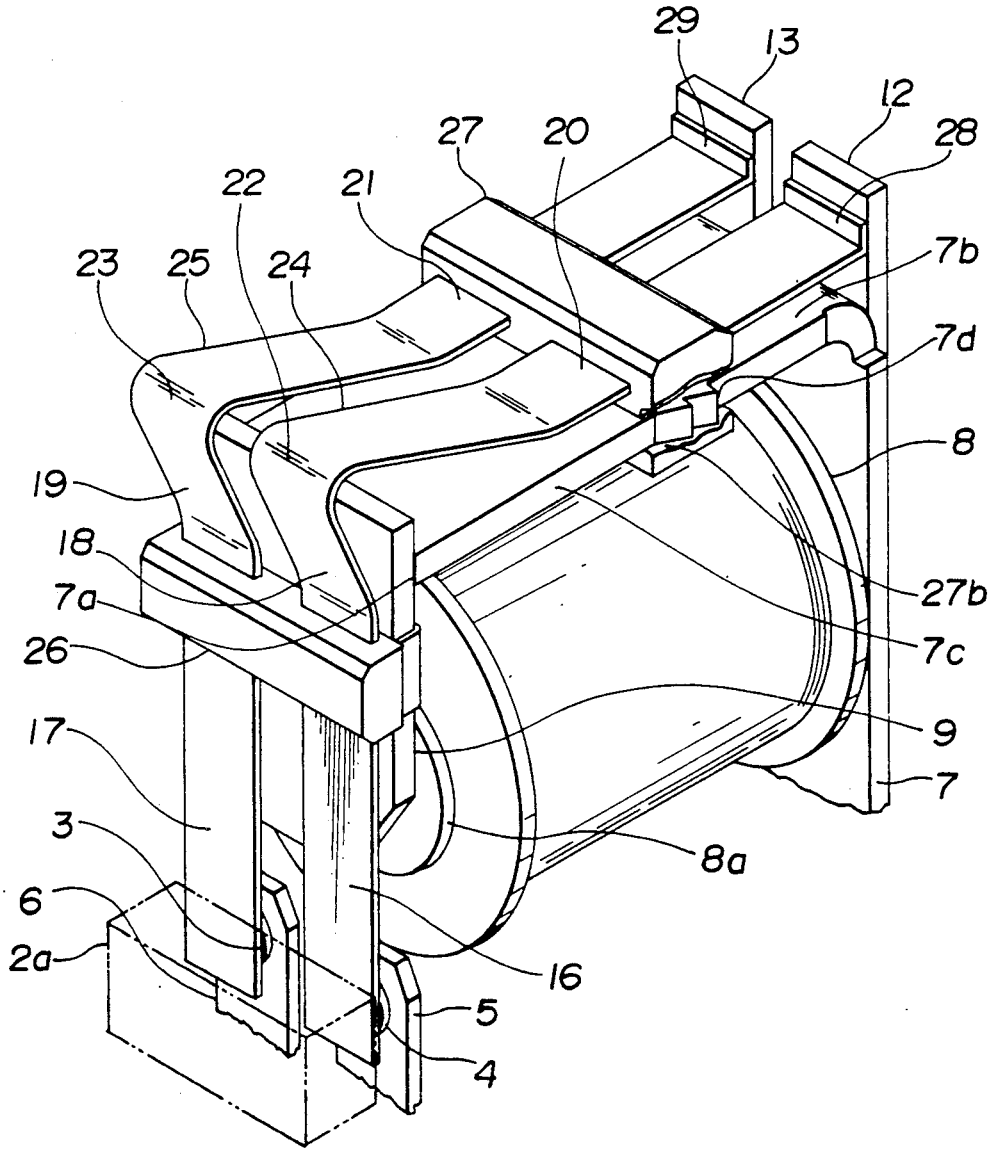
FIG. 3 is a perspective view illustrating the neighborhood of the resilient pieces of the electromagnetic relay shown in FIG. 1.

The base 2 is fixed with coil terminals 10 and 11 connected with respective ends of wound wire 8*b* of the coil 8 on both sides of the frame 7 fixed on the base 2 as also shown in FIG. 2, and fixed with movable contact terminals 12 and 13 respectively on the right side of the frame 7 in FIG. 2.

And the frame 7 is fixed with L-like shaped resilient pieces 24 and 25 which are made of conducting material and attached with the armature 9 through an insulating block 26 at respective armature setting parts 18 and 19, and which are provided with movable contacts 14 and 15 to be in contact or out of contact with the respective fixed contacts 3 and 4 at their lower ends in FIG. 1, contacting parts 28 and 29 to be connected electrically with the movable contact terminals 12 and 13 at the opposite ends, and spring parts 22 and 23 for energizing the armature 9 in the direction away from the iron core 8*a* at the middle portion as united one body.

Namely, the armature 9 is fitted to the insulating block 26 at the nearly center portion which is made of non-conducting material and fixed to the resilient pieces 24 and 25, and the resilient pieces 24 and 25 are supported on the frame 7 by fitting an insulating member 27 which is fixed to the resilient pieces 24 and 25 at frame setting parts 20 and 21.

The insulating member 27 has a rectangular prism-like shape and is made of non-conducting material, and is fixed to the frame setting parts 20 and 21 of the resilient pieces 24 and 25 at resilient piece fitting parts 27*a* sited on the upper side thereof in FIG. 1, respectively.

And the insulating member 27 is attached to the frame 7 by press-fitting a square-hole shaped frame fitting part 27*b* provided in the insulating member 27 on the lower side away from the resilient piece fitting parts 27*a* onto an upper frame plate 7*b* of the frame 7.

The frame plate 7*b* is provided with serration 7*d*'s projecting outwardly from respective side edges 7*c* as shown in FIG. 2, and the insulating member 27 is so designed as to be fitted on the predetermined position by the serrations 7*d*.

Figure 4:
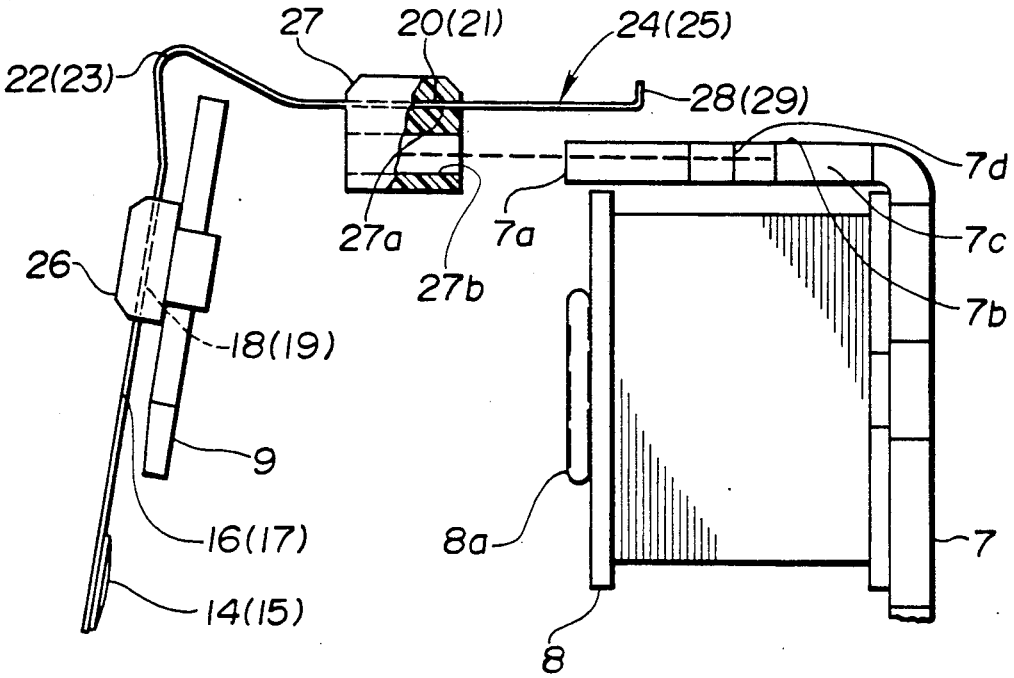
FIG. 4 and FIG. 5 are side views illustrating the process for mounting the resilient pieces to the frame in the electromagnetic relay shown in FIG. 1, respectively.
Figure 5:
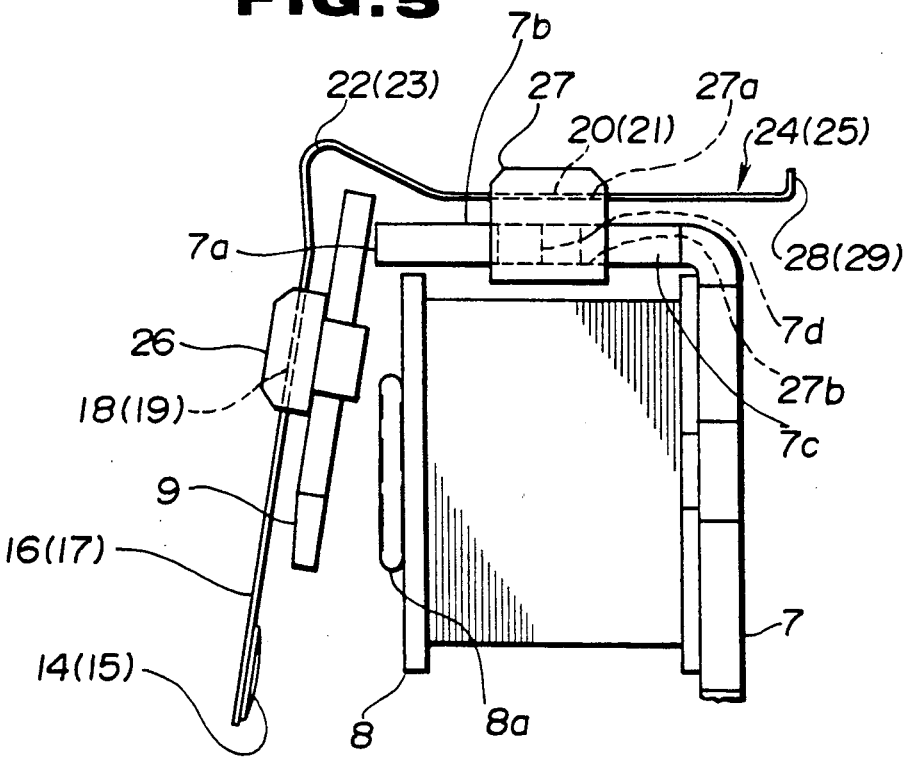
Figure 6:
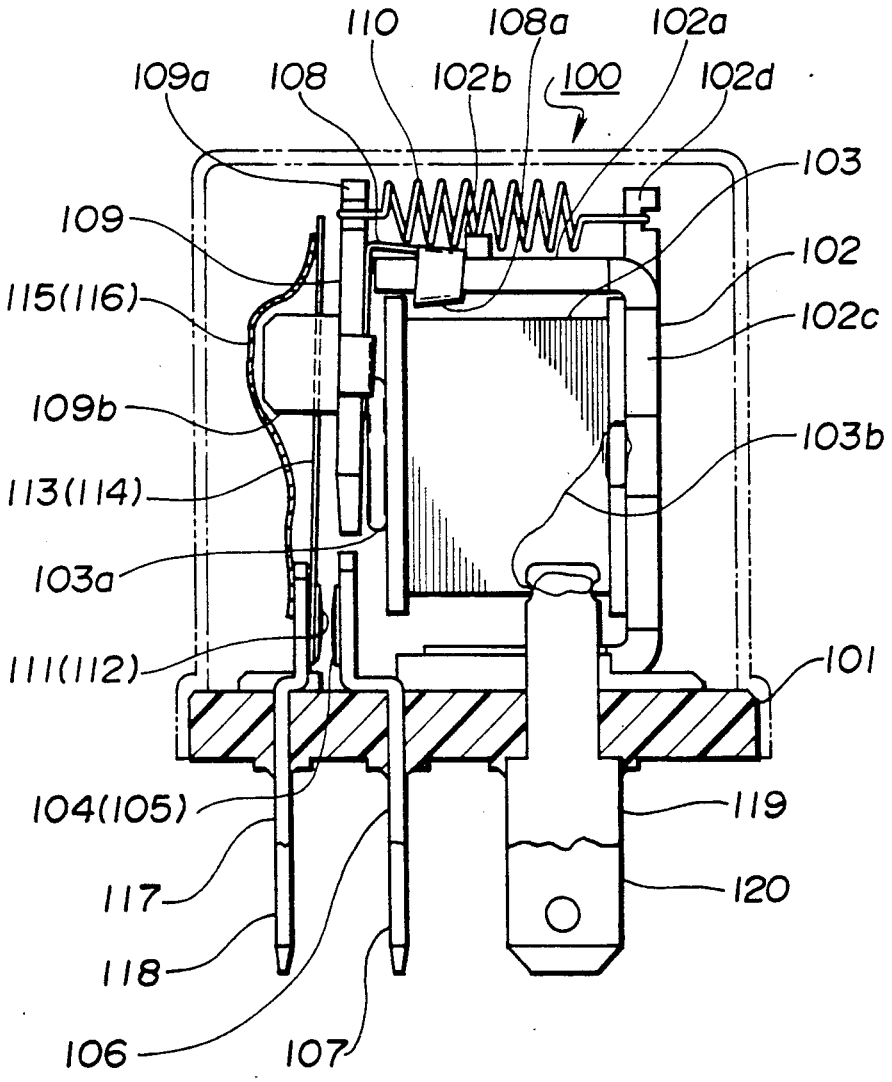
FIG. 6 (PRIOR ART)
FIG. 6 and FIG. 7 are partially sectional side view and partially sectional front view of the conventional electromagnetic relay, respectively.
Figure 7:
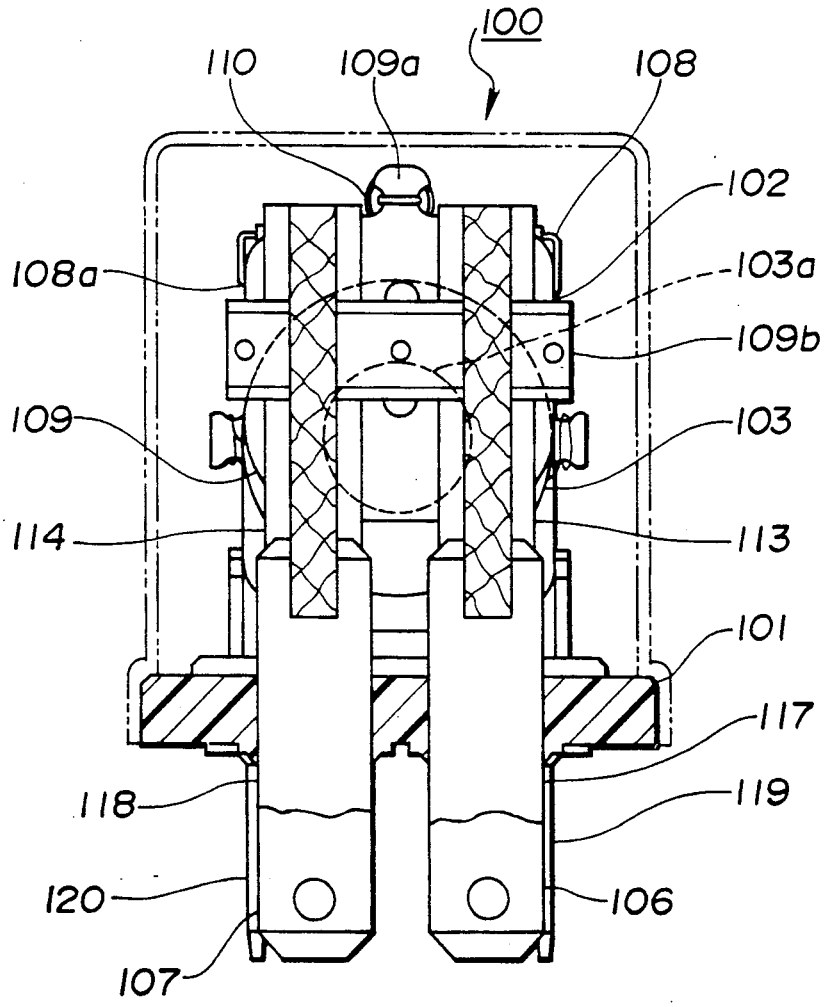
FIG. 7 (PRIOR ART)

Namely, the respective resilient pieces 24 and 25 are so structured as to be fixed to the predetermined position on the frame 7 by press-fitting the frame fitting part 27*b* provided in the insulating member 27 fixed with the resilient pieces 24 and 25 by, for example, insert molding or the like from the left side of the frame plate 7*b* as shown in FIG. 4 onto the serrations 7*d* provided on the both side edges 7*c* of the upper frame plate 7*b* until the distance between the armature 9 and the iron core 8*a* may be in accord with the predetermined distance.

The armature 9 is energized in the direction away from the iron core 8*a* by the spring parts 22 and 23 of the respective resilient pieces 24 and 25, and respective movable contact piece parts 16 and 17 forming a part of the respective resilient pieces 24 and 25 are also energized in the clockwise direction in FIG. 1, the movable contact piece parts 16 and 17 are in contact with a projection 2*a* formed on the base 2 at the state in which the respective movable contact piece parts 16 and 17 of the resilient pieces 24 and 25 are separate from the fixed contacts 3 and 4, respectively.

The respective resilient pieces 24 and 25 are provided with the contacting parts 28 and 29 at the opposite ends from the ends provided with the movable contacts 14 and 15 by bending the ends into L-like shapes, and the contacting parts 28 and 29 are fixed with the movable contact terminals 12 and 13.

And at the state in which the coil 8 is not excited as shown in FIG. 1, the armature 9 separates from the iron core 8*a* by the respective spring parts 22 and 23 of the resilient pieces 24 and 25, therefore the movable contacts 14 and 15 separate from the fixed contacts 3 and 4 respectively.

In this state, supplying a predetermined electric power to the coil 8 through the coil terminals 10 and 11 by changing a switch (not shown), the coil 8 is excited and magnetic flux passing from the iron core 8*a* to the same iron core 8*a* through the frame 7 and the armature 9, the armature 9 is attracted toward the iron core 8*a* (in the rightward direction in FIG. 1).

When the armature 9 is attracted toward the side of the iron core 8*a*, respective movable contact piece parts 16 and 17 rotate in the anticlockwise direction about the spring parts 22 and 23 in FIG. 1, and separate from the projection 2*a*. And the respective movable contacts 14 and 15 come in contact with the respective fixed contacts 3 and 4 rotation of the movable contact piece parts 16 and 17 of the resilient pieces 24 and 25 in the anticlockwise directions.

Thereby, the fixed contact terminal 5 and the movable contact terminal 12 are connected electrically, and another fixed contact terminal 6 and another movable contact terminal 13 are connected electrically.

And in this state, intercepting the power supply through the coil terminals 10 and 11 for the coil 8 by changing the switch, the coil 8 becomes unexcited state and discontinues attracting the armature 9, so that the armature 9 returns in the clockwise direction together with the respective movable contact piece parts 16 and 17 of the resilient pieces 24 and 25 by the elasticity of the respective spring parts 22 and 23.

According to the return of the armature 9, the respective movable contact piece parts 16 and 17 come in contact with the projection 2*a* and disconnect the movable contacts 14 and 15 from the fixed contacts 3 and 4 respectively, so that the electric connection between the fixed contact terminal 5 and the movable contact terminal 12 are intercepted and the electric connection between another fixed contact terminal 6 and another movable contact terminal 13 are also intercepted, the electromagnetic relay 1 returns in the state shown in FIG. 1.

In the electromagnetic relay 1 according to this invention, the resilient pieces 24 and 25 are fixed up on the frame 7 at the predetermined proper position so as to make the distance between the armature 9 and the iron core 8*a* regular, therefore it is possible to produce the electromagnetic relay having high and regular performance without dispersion among respective products.

As mentioned above, the electromagnetic relay according to this invention comprises a frame for forming a magnetic circuit, a coil having an iron core fixed to the frame, an armature to be attracted by the iron core in accordance with an excitation of the coil, at least two of resilient pieces attached with the armature and fixed to the frame, movable contacts fixed to the respective resilient pieces, movable contact terminals to be connected with the respective movable contacts, fixed contacts to be in contact or out of contact with the respective movable contacts in response to an attraction of the armature caused by the excitation of the coil, fixed contact terminals provided with the respective fixed contacts, and each of the resilient pieces is fixed to the frame through an insulating member and provided with the movable contact at one end, a contacting part to be connected with the movable contact terminal at another end, and a spring part for energizing the armature in the direction away from the iron core in an unexcited state of the coil at a middle portion thereof as united one body. Therefore, it is possible to reduce the parts in number because some parts such as the hinge, the coil spring and the woven wires fall into disuse as compared with the conventional electromagnetic relay.

Accordingly, excellent effects are obtained in that it is possible to reduce the production cost and the dispersion in the performance of the electromagnetic relay because of the decrease of errors in measurement caused by assembling the parts.

What is claimed is:

1. An electromagnetic relay comprising:
- a frame for forming a magnetic circuit;
- a coil having an iron core fixed to said frame;
- an armature to be attracted by said iron core in accordance with an excitation of the coil;
- at least two of resilient pieces attached with the armature and fixed to the frame;
- movable contacts fixed to said respective resilient pieces;
- movable contact terminals to be connected with said respective movable contacts;
- fixed contacts to be in contact or out of contact with said respective movable contacts in response to an attraction of the armature caused by the excitation of the coil;
- fixed contact terminals provided with said respective fixed contacts; and
- each of said resilient pieces being fixed to the frame through an insulating member and provided with said movable contact at one end, a contacting part to be connected with said movable contact terminal at another end, and a springpart for energizing said armature in the direction away from said iron core in an unexcited state of the coil at a middle portion thereof as united one body.

2. An electromagnetic relay as set forth in claim 1, wherein said frame is provided with a serration on an upper frame plate thereof for making a distance between the armature and the iron core of the coil uniform by controlling mouting position of the insulating member fixed with the resilient pieces.

* * * * *